US009949053B2

(12) United States Patent
Grosche et al.

(10) Patent No.: US 9,949,053 B2
(45) Date of Patent: Apr. 17, 2018

(54) METHOD AND MOBILE DEVICE FOR PROCESSING AN AUDIO SIGNAL

(71) Applicant: Huawei Technologies Co., Ltd., Shenzhen, Guangdong (CN)

(72) Inventors: Peter Grosche, Munich (DE); Yue Lang, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/142,024

(22) Filed: Apr. 29, 2016

(65) Prior Publication Data

US 2016/0249151 A1 Aug. 25, 2016

Related U.S. Application Data

(63) Continuation of application No. PCT/EP2013/072729, filed on Oct. 30, 2013.

(51) Int. Cl.

*H04S 7/00* (2006.01)
*H04S 1/00* (2006.01)
*H04S 3/00* (2006.01)

(52) U.S. Cl.

CPC ..... *H04S 7/30* (2013.01); *H04S 1/002* (2013.01); *H04S 3/002* (2013.01); *H04S 1/005* (2013.01);

(Continued)

(58) Field of Classification Search

CPC . H04S 7/30; H04S 1/002; H04S 3/002; H04S 1/005; H04S 2400/01; H04S 2400/03; H04S 2400/05; H04S 2420/01

(Continued)

(56) References Cited

U.S. PATENT DOCUMENTS 6,016,473 A * 1/2000 Dolby ..... G10L 19/008 704/500
6,950,524 B2 9/2005 Nelson et al.

(Continued)

FOREIGN PATENT DOCUMENTS

CN 1189081 A 7/1998
CN 1605226 A 4/2005

(Continued)

OTHER PUBLICATIONS

B. B. Bauer, "Stereophonic Earphones and Binaural Loudspeakers", Journal of the Audio Engineering Society, vol. 9, No. 2, Apr. 1961, p. 148-151.

(Continued)

*Primary Examiner* — David Ton

(57) ABSTRACT

A method for processing an audio signal includes: decomposing an audio signal comprising spatial information into a set of audio signal components; and processing a first subset of the set of audio signal components according to a first processing scheme and processing a second subset of the set of audio signal components according to a second processing scheme different from the first processing scheme, wherein the first subset comprises audio signal components corresponding to at least one frontal signal source and the second subset comprises audio signal components corresponding to at least one ambient signal source; and wherein the second processing scheme is based on crosstalk cancellation.

10 Claims, 10 Drawing Sheets

(52) U.S. Cl.
CPC ..... *H04S 3/004* (2013.01); *H04S 2400/01* (2013.01); *H04S 2400/03* (2013.01); *H04S 2400/05* (2013.01); *H04S 2420/01* (2013.01)

(58) Field of Classification Search
USPC ..... 381/17–19, 310, 307
See application file for complete search history.

(56) References Cited

U.S. PATENT DOCUMENTS

| | | | | |
|---|---|---|---|---|
| 7,974,418 | B1 | 7/2011 | Sakurai et al. | |
| 2005/0053249 | A1* | 3/2005 | Wu | H04S 5/005 381/310 |
| 2005/0129249 | A1* | 6/2005 | Chabanne | H04S 3/002 381/17 |
| 2005/0135643 | A1* | 6/2005 | Lee | H04S 3/008 381/309 |
| 2005/0271214 | A1* | 12/2005 | Kim | H04S 1/002 381/17 |
| 2005/0281408 | A1 | 12/2005 | Kim et al. | |
| 2007/0154020 | A1* | 7/2007 | Katayama | H04S 1/002 381/17 |
| 2007/0291950 | A1* | 12/2007 | Kimura | H04S 1/002 381/20 |
| 2008/0031462 | A1* | 2/2008 | Walsh | H04S 3/02 381/17 |
| 2008/0273721 | A1* | 11/2008 | Walsh | H04S 5/00 381/300 |
| 2010/0027799 | A1* | 2/2010 | Romesburg | H04R 5/04 381/28 |
| 2012/0051565 | A1* | 3/2012 | Iwata | H04S 3/002 381/300 |
| 2013/0163766 | A1 | 6/2013 | Choueiri | |

FOREIGN PATENT DOCUMENTS

| | | | |
|---|---|---|---|
| CN | 1713784 | A | 12/2005 |
| CN | 1901761 | A | 1/2007 |
| EP | 1775994 | A1 | 4/2007 |
| EP | 1971187 | A2 | 9/2008 |
| GB | 2448980 | A | 11/2008 |
| WO | 98/20709 | A1 | 5/1998 |

OTHER PUBLICATIONS

Edgar Y. Choueiri, "Optimal Crosstalk Cancellation for Binaural Audio with Two Loudspeakers", 24 pages.

Frank Baumgarte et al., "Binaural Cue Coding—Part I: Psychoacoustic Fundamentals and Design Principles", IEEE Transactions on Speech and Audio Processing, vol. 11, No. 6, Nov. 2003, p. 509-519.

R. Irwan et al, "Two-to-Five Channel Sound Processing", J. Audio Eng. Soc., vol. 50, No. 11, Nov. 2002, p. 914-926.

"Multichannel stereophonic sound system with and without accompanying picture; BS Series Broadcasting service (sound)", International Telecommunication Union Recommendation ITU-R Bs.775-3, Aug. 2012, 25 pages.

Ole Kirkeby et al., "The "Stereo Dipole"—A Virtual Source Imaging System Using Two Closely Spaced Loudspeakers", J. Audio Eng. Soc., vol. 46, No. 5, May 1998, p. 387-395.

Bruno Masiero et al., "Review of the crosstalk cancellation filter technique", 5 pages.

Takashi Takeuchi et al., "Optimal source distribution for binaural synthesis over loudspeakers", J. Acoust. Soc. Am. 112 (6), Dec. 2002, p. 2786-2797.

Earl Vickers, "Frequency-Domain Two-to Three-Channel Upmix for Center Channel Derivation and Speech Enhancement", 24 pages.

* cited by examiner a)

b)

METHOD AND MOBILE DEVICE FOR PROCESSING AN AUDIO SIGNAL

CROSS-REFERENCE TO RELATED APPLICATIONS

This application is a continuation of International Application No. PCT/EP2013/072729, filed on Oct. 30, 2013, which is hereby incorporated by reference in its entirety.

TECHNICAL FIELD

The present disclosure relates to a method for processing an audio signal and a mobile device applying such method. The disclosure further relates to audio systems for creating enhanced spatial effects in mobile devices, in particular audio systems applying crosstalk cancellation.

BACKGROUND

There are many devices with two transducers on the market, such as laptops, tablet computer, mobile phones, and smartphones, as well as iPod or smartphone docking stations and soundbars for TVs. Compared to a conventional stereo system with two discrete loudspeakers, the two transducers of such devices are located in a single cabinet or enclosure and are typically placed very close to each other (due to the size of the device, they are usually spaced by only few centimeters, between 2 and cm for mobile device such as smartphones or tablets). For typical listening distances, the loudspeaker span angle θ as illustrated in FIG. 1*a* is small, i.e., less than 60 degrees as recommended for stereo playback according to ITU Recommendation BS.775-3, "Multichannel stereophonic sound system with and without accompanying picture", ITU-R, 2012.

This results in sound reproduction which is narrow, almost "mono-like". When playing a stereo recording on such devices, all sound sources are perceived as being centered, any spatial information, where sounds sources would be localized for example on the left or on the right side of the listener is missing. Even worse, multi-channel signals with the goal to create a surround effect with sources placed all around the listener cannot be realized using single-cabinet loudspeakers.

A typical approach to increasing the spatial effect of such single cabinet devices is to use crosstalk cancellation techniques as described by Bauer, B. B., "Stereophonic earphones and binaural loudspeakers", Journal Audio Engineering Society 9, 148-151, 1961. The general goal of crosstalk cancellation is to attenuate crosstalk. Crosstalk refers to the undesired signal path C between a speaker, e.g. a loudspeaker 105, 107 of a mobile device 103 as depicted in FIG. 1, and the contra-lateral ear i.e., the path between the right speaker R 107 and left ear l and the path between the left speaker L 105 and the right ear r as shown in FIG. 1*b*. As a result of cancelling crosstalk, it is possible to present binaural signals to the listener's ears which allows positioning acoustic sources 109 virtually in an area 111 all around the listener and obtaining a stereo widening or virtual surround effect as illustrated in FIG. 1*c*.

In practice, crosstalk cancellation may be implemented using filter inversion techniques. Channel separation is achieved by means of destructive wave interference at the position of the listener's ears. Intuitively speaking, each desired signal intended for the ispi-lateral ear produced by one speaker is output a second time (delayed and phase inverted) in order to obtain the desired cancellation at the position of the contra-lateral ear. As a result, high signal amplitudes and sound pressure levels are required to be produced by the speakers only to be later canceled at the listener ears. This effect reduces the efficiency of the electro-acoustic system; it may lead to distortions as well as a reduced dynamic range and reduced maximum output level.

The applicability of crosstalk cancellation systems for creating enhanced spatial effects in mobile devices is limited by the high load they typically put on the electro-acoustic system consisting of amplifiers and speakers.

The performance of crosstalk cancellation based on filter inversion techniques or first-order directivity processing shows strong frequency dependence. In particular for low-frequencies, the difference Δl between the direct path D and the crosstalk path C is very small (relative to the wavelength). In this case, the required delay $$\tau_c = \frac{\Delta l}{c_s}$$

(with the speed of sound $c_s \approx 340$ m/s) is very small which results in ipsi- and contra-lateral signals being very similar. FIG. 2 shows an example frequency response 200 of a typical crosstalk cancellation filter. Obviously, in particular for low frequencies a large gain is required.

In fact, for small $\omega\tau_c$ a desired attenuation of the contra-lateral signal induces an undesired attenuation of the ipsi-lateral signal. To overcome this attenuation of the ipsi-lateral attenuation, a high amplification of certain frequencies is required. In particular for systems with loudspeakers exhibiting small span angles θ (see FIG. 1*a*), low frequencies need to be amplified significantly and high sound pressure levels need to be produced by the speakers (only to be later cancelled by destructive wave interferences at the listener's ears) which results in a significant loss of gain and dramatically constraints the maximum output level and limits the dynamic range of the system. Overall, this characteristic which is common to all crosstalk cancellation techniques limits the crosstalk cancellation efficiency (i.e., the ratio of the sound pressure at the desired signal resulting at the position of listeners ears to the overall sound pressure produced by the speakers). In other words, there is a high crosstalk cancellation effort put on the speakers.

This problem becomes particularly severe for applications of crosstalk cancellation in mobile devices. Such devices typically are equipped with very small speakers and low-power amplifiers. Furthermore, the speakers are placed at small loudspeaker span angles. As the ability to produce high sound pressure levels (in particular for low frequencies) is limited using such small transducers and low-power amplifiers, any further amplification required by the crosstalk cancellation system typically results in inadequately low sound pressure levels, drastically reduced dynamic range, and even distortions resulting from overloading the loudspeakers and amplifiers, as well as saturating the digital signal processing equipment.

Several solutions to this problem exist which require an adaptive placement of the speakers in terms of spanning angle or use regularization to restrict the maximum amplification level.

Regularization (constant parameter and frequency-depended regularization) can be used for reducing the loss of dynamic range loss caused by the system inversion. Regularization constraints the additional amplification introduced by the crosstalk cancellation systems. However, in turn, it also constraints the ability of the signal to cancel crosstalk and therefore constitutes a means to control the unavoidable trade-off between accepted loss of dynamic range and desired attenuation of crosstalk. High dynamic range and high crosstalk attenuation for creating a large spatial effect cannot be achieved simultaneously.

Optimal Source Distribution is a technique which reduces the loss of dynamic range loss by continuously varying the loudspeaker span angle based on frequency. For high frequencies, a small loudspeaker span angle is used, for low frequencies the loudspeaker span angle is more and more increased resulting in larger $\omega\tau_c$ values. Obviously, this technique requires several loudspeakers (more than two) which are spanned up to 180°. For each frequency range, the loudspeakers are used which require the least effort, i.e., need to emit the smallest output power. For mobile devices, this solution is not applicable because all speakers are placed in a single (typically small) enclosure which limits the achievable span angles.

The main advantage of using crosstalk cancellation techniques is that binaural signals can be presented to the listener which opens the possibility to place acoustic sources virtually all around the listener's head, spanning the entire 360° azimuth as well as elevation range as illustrated in FIG. 3. A number of factors affect the spatial aspects of how a sound is perceived; mainly interaural-time and interaural-level differences cues are relevant for azimuth localization of sound sources.

The separation of an audio signal into frontal and surrounding sources is a well-studied problem in the field of 2-to-3 or 2-to-5 channel up-mixing, see Vickers, E.; "Frequency-Domain Two- To Three-Channel Upmix for Center Channel Derivation and Speech Enhancement," Audio Engineering Society Convention 127, 2009 and Irwan, R., Aarts, R. M., "Two-to-Five Channel Sound Processing", JASA 50(11), 2002. Here, given a conventional stereo recording (consisting of 2 channels left L and right R), the goal is to derive additional channels to obtain an additional center channel or 5.1 multi-channel surround sound signal for improved playback using 5.1 speaker setups.

For extracting a center channel, the goal is to decompose a stereo signal by first extracting any information common to the left and right inputs L, R and assigning this to the center channel and assigning the residual signal energy to the left and right channel (see FIG. 5*a*). The same principal can be used for separating the stereo signal into frontal sources and surrounding sources. Here, information common to the left and right channels corresponds to frontal sources M; any residual audio energy is assigned to the left side surrounding SL or right side surrounding SR sources (see FIG. 5*b*).

The separation may be based on the following signal model as described by Vickers, E.; "Frequency-Domain Two- To Three-Channel Upmix for Center Channel Derivation and Speech Enhancement," Audio Engineering Society Convention 127, 2009:

$$L=0.5M+SL$$

$$R=0.5M+SR,$$

where M corresponds to the common signal parts which are the same in L and R, SL and SR correspond to the residual side signal parts. The basic assumption is that there is a primary or dominant source P which can be observed in a framed subband representation of the signal. P is assumed to be panned somewhere between the left and the right channel of the input signal. For the separation into common and surrounding signal parts, the idea is to represent P using a Mid component M and a side component SL (in the case P is pointing further to the left side) or right component SR (in the case P is pointing further to the right), see FIG. 5.

As described in Irwan, R., Aarts, R. M., "Two-to-Five Channel Sound Processing", JASA 50(11), 2002, see FIG. 4, the separation unit 400 may perform PCA (Principal Component Analysis) 403 on framed sub-bands 404 in frequency domain obtained by FFT transform and subband decomposition 401 to derive the signals M, SL, and SR 406, according to the following instructions:

Compute the rotation angle between left and right input channels 404 using PCA (Principal Component Analysis) 403 which corresponds to the direction of the dominant source P in the respective framed sub-band;

Derive M corresponding to the projection of the dominant source to the frontal direction; and S represents the remaining parts of the stereo content;

SL and SR can be obtained by mapping S to the more pronounced channel depending on the contribution of L and R to S;

M, SL and SR 406 may be transformed into time domain 408 by using an IFFT 405.

Many different solutions may be applied to obtain the desired separation and different terms may be used for the different components, e.g., common or centered or frontal parts are equivalent terms, also surrounding or side or ambient parts are equivalent terms.

The Mid signal M contains all frontal sources, the side signals SL and SR contain the surrounding sources. For widening the stereo signal when playing on mobile devices with small loudspeaker span angles, the stereo widening using crosstalk cancellation is only required for processing the surrounding signals SL and SR. The mid signal M containing frontal source can be reproduced using conventional amplitude panning.

Applications of crosstalk cancellation techniques as described above in mobile devices with the goal to create an enhanced spatial effect (stereo widening, virtual surround playback, binaural reproduction) suffer from either low channel separation (low attenuation of crosstalk) or low dynamic range and limited maximum output level when achieving high attenuation of crosstalk. Prior art solutions only provide a means for controlling the unavoidable trade-off between the two contradicting aspects.

SUMMARY

One object of present disclosure is to provide a technique for improved spatial sound reproduction with low crosstalk cancellation effort.

This object is achieved by the features of the independent claims. Further implementation forms are apparent from the dependent claims, the description and the figures.

The invention as described in the following is based on the fundamental observation that the required amount of signal energy to be processed by the crosstalk cancellation system can be reduced by separating the input signal into frontal and surrounding acoustic sources and then applying crosstalk cancellation only to the surrounding sources for creating a spatial effect. Frontal sources may not be processed by the crosstalk cancellation system as they do not contribute to the spatial effect. By such partial crosstalk cancellation an enhanced spatial sound reproduction for acoustic devices and in particular for mobile devices may be facilitated thereby providing a large spatial effect and simultaneously keeping the load on the electro-acoustic system down.

An audio signal processing method applying such partial crosstalk cancellation may enhance the performance of crosstalk cancellation systems for mobile devices by reducing the required amount of signal energy to be processed by the crosstalk cancellation system. In particular, the invention is based on the finding that after a separation of the input signal into frontal and surrounding sources crosstalk cancellation is applied only to acoustic sources corresponding to the surrounding sources where it is needed for creating a spatial effect. Frontal sources may not be processed by the crosstalk cancellation system. This technique facilitates a spatial sound reproduction with maximum spatial effect and low crosstalk cancellation effort.

For obtaining a convincing spatial effect, it is not required to use crosstalk cancellation for all frontal sources 301 (see FIG. 3). Crosstalk cancellation is only required to accurately place the surrounding sources 302. Frontal sources 301 located in the direction towards a listener can be accurately positioned using simple amplitude panning between the left speaker L and the right speaker R. The use of crosstalk cancellation can be avoided for these without changing the spatial perception of the signal.

For example, in a stereo widening scenario of a music signal, frontal sources do not need to be processed by the crosstalk cancellation system in order to obtain a widening effect. Only sources which are placed on the left or right side of the listener need to be processed by the crosstalk cancellation system. For a typical stereo pop music signal, frontal sources may correspond to the singing voice, bass, and drums. Actually, 50% of the overall signal energy may be contributed by these frontal sources which are centered i.e., the same in both channels. At the same time, only 50% of the entire signal energy is actually contributed by left and right sources. Separating the signal into frontal and surrounding sources and applying crosstalk cancellation in a selective manner only to the surrounding sources, allows to achieve a high channel separation (high attenuation of crosstalk) leading to convincing spatial effects. Simultaneously, the crosstalk cancellation effort is reduced and the high dynamic range and high output sound pressure levels can be achieved.

In order to describe the invention in detail, the following terms, abbreviations and notations will be used:

M: mid channel,
L: left channel,
R: right channel,
SL: left side or left ambient channel,
SR: right side or right ambient channel,
FR: front right channel,
FL: front left channel,
BR: back right channel,
BL: back left channel,
HRTF: Head-Related Transfer Function,
BCC: binaural cue coding,
OSD: optimal source distribution.

According to a first aspect, the invention relates to a method for processing an audio signal, the method comprising: decomposing an audio signal comprising spatial information into a set of audio signal components; and processing a first subset of the set of audio signal components according to a first processing scheme and processing a second subset of the set of audio signal components according to a second processing scheme different from the first processing scheme, wherein the first subset comprises audio signal components corresponding to at least one frontal signal source and the second subset comprises audio signal components corresponding to at least one ambient signal source; and wherein the second processing scheme is based on crosstalk cancellation.

By using such different processing schemes improved spatial sound reproduction with low crosstalk cancellation effort may be provided because crosstalk cancellation is only required for the signal components corresponding to ambient signal sources.

In a first possible implementation form of the method according to the first aspect, the decomposing the audio signal is based on Principal Component Analysis.

PCA (Principal Component Analysis) provides the direction of the dominant source P and may thus be used to efficiently decompose the audio signal.

In a second possible implementation form of the method according to the first aspect as such or according to the first implementation form of the first aspect, the second processing scheme is further based on Head-Related Transfer Function processing.

A head-related transfer function (HRTF) is a response that characterizes how an ear receives a sound from a point in space. HRTF processing thus provides a better spatial impression.

In a third possible implementation form of the method according to the first aspect as such or according to any of the previous implementation forms of the first aspect, the first processing scheme comprises amplitude panning.

To obtain a centered location, amplitude panning may be used which results in a phantom center source, i.e. in an improved spatial impression.

In a fourth possible implementation form of the method according to the first aspect as such or according to any of the previous implementation forms of the first aspect, the first processing scheme comprises delay and gain compensation.

Delay and gain compensation are easy to implement in contrast to crosstalk cancellation. Thus, the method applying the first processing scheme including delay and gain compensation is computationally efficient.

In a fifth possible implementation form of the method according to the first aspect as such or according to any of the previous implementation forms of the first aspect, the first and second subsets of the set of audio signal components each comprise a first part associated with a left direction and a second part associated with a right direction.

The audio signal may include both a stereo audio signal and a multichannel audio signal both may include a part associated with a left direction and a part associated with a right direction. Thus, different scenarios and use cases can be handled by this method.

In a sixth possible implementation form of the method according to the fifth implementation form of the first aspect, the method comprises: combining the first part of the first subset of the set of audio signal components after being processed according to the first processing scheme and the first part of the second subset of the set of audio signal components after being processed according to the second processing scheme to a left channel signal; and combining the second part of the first subset of the set of audio signal components after being processed according to the first processing scheme and the second part of the second subset of the set of audio signal components after being processed according to the second processing scheme to a right channel signal.

The combining is required for generating the loudspeaker signals. Such combined signals provide an improved spatial effect as sources corresponding to different directions are included in these combined signals.

In a seventh possible implementation form of the method according to the first aspect as such or according to any of the previous implementation forms of the first aspect, the audio signal comprises a stereo audio signal; and the decomposing is based on converting the stereo audio signal into a mid signal component associated to the first subset of the set of audio signal components and into a left side signal component and right side signal component both associated to the second subset of the set of audio signal components.

The method allows improved signal processing for stereo signals thereby improving spatial impression of stereo signals.

In an eighth possible implementation form of the method according to the first aspect as such or according to any of the previous implementation forms of the first aspect, the audio signal comprises a multichannel audio signal; and the decomposing is based on decoding the multichannel audio signal into the following signal components: a center signal component, a front right signal component, a front left signal component, a back right signal component, a back left signal component.

The method allows improved signal processing for multichannel signals thereby improving spatial impression of multichannel signals.

In a ninth possible implementation form of the method according to the eighth implementation form of the first aspect, the center signal component is associated to the first subset of the set of audio signal components; and the front right, the front left, the back right and the back left signal components are associated to the second subset of the set of audio signal components.

When the front right, the front left, the back right and the back left signal components are crosstalk cancelled, the method provides a high spatial impression.

In a tenth possible implementation form of the method according to the eighth implementation form of the first aspect, the center signal component and both the front right and front left signal components are associated to the first subset of the set of audio signal components; and both the back right and back left signal components are associated to the second subset of the set of audio signal components.

When only the back right and the back left signal components are crosstalk cancelled, the method provides a low energy solution with a high dynamic range and low computational complexity.

In an eleventh possible implementation form of the method according to the eighth implementation form of the first aspect, the method further comprises: converting the front right and front left signal components into a mid signal component associated to the first subset of the set of audio signal components and into a left side and right side signal component both associated to the second subset of the set of audio signal components; wherein the center signal component is associated to the first subset of the set of audio signal components; and wherein both the back right and back left signal components are associated to the second subset of the set of audio signal components.

By that conversion, multichannel signals may be treated similar to stereo signals resulting in improved spatial impression at a high dynamic range and low computational complexity.

In a twelfth possible implementation form of the method according to the first aspect as such or according to any of the previous implementation forms of the first aspect, the first processing scheme is free of crosstalk cancellation.

By not having a crosstalk cancellation in the first processing scheme a computation effort can be reduced for the first subset of the set of audio signal components in which such crosstalk cancellation is not needed.

According to a second aspect, the invention relates to a mobile device, comprising a processor configured to execute the method according to the first aspect as such or according to any one of the first to the eleventh implementation forms of the first aspect. The mobile device may further comprise at least one left channel loudspeaker configured to play the left channel signal according to the sixth implementation form of the first aspect and at least one right channel loudspeaker configured to play the right channel signal according to the sixth implementation form of the first aspect.

The processor may be configured to decompose an audio signal comprising spatial information into a set of audio signal components; process a first subset of the set of audio signal components according to a first processing scheme; and process a second subset of the set of audio signal components according to a second processing scheme different from the first processing scheme; wherein the first subset comprises audio signal components corresponding to at least one frontal signal source and the second subset comprises audio signal components corresponding to at least one ambient signal source; and wherein the second processing scheme is based on crosstalk cancellation.

Such mobile devices create an enhanced spatial effect with respect to stereo widening, virtual surround playback and binaural reproduction even when the loudspeakers are arranged close to each other. They provide high channel separation by high attenuation of crosstalk and a high dynamic range at a maximum output power level.

According to a third aspect, the invention relates to a computer program or computer program product comprising a readable storage medium storing program code thereon for use by a computer, the program code comprising: instructions for decomposing an audio signal comprising spatial information into a set of audio signal components; and instructions for processing a first subset of the set of audio signal components according to a first processing scheme and processing a second subset of the set of audio signal components according to a second processing scheme different from the first processing scheme, wherein the first subset comprises audio signal components corresponding to at least one frontal signal source and the second subset comprises audio signal components corresponding to at least one ambient signal source; and wherein the second processing scheme is based on crosstalk cancellation.

A computer program product using such different processing schemes provides improved spatial sound reproduction with low crosstalk cancellation effort when implemented on a processor because crosstalk cancellation is only required for the signal components corresponding to ambient signal sources. The computer program product may run on many mobile devices. It may be updated with respect to the physical environment or with respect to the hardware platform on which it is running.

The techniques described hereinafter provide a solution to reducing the load put on the electro-acoustic system when using crosstalk cancellation for creating an enhanced spatial effect. A large spatial effect and high sound pressure levels can be obtained even on mobile devices with an electro-acoustic system of limited capability. They can be applied to enhance the spatial effect for stereo and multi-channel playback. The techniques constitute a pre-processing step which can be combined with any crosstalk cancellation scheme. The techniques can be applied flexibly in different embodiments with a focus on obtaining high spatial effects or reducing the loudspeaker effort while still retaining good spatial effects. Combinations with prior-art solutions to enhancing the efficiency of crosstalk cancellation such as the optimal source distribution (OSD) and regularization are possible. Such combinations with prior art solutions will benefit from a lower number of required speakers (OSD) or less required regularization (higher crosstalk attenuation).

BRIEF DESCRIPTION OF THE DRAWINGS

Further embodiments of the invention will be described in the following with respect to the accompanying figures, in which.

DETAILED DESCRIPTION

Figure 1:
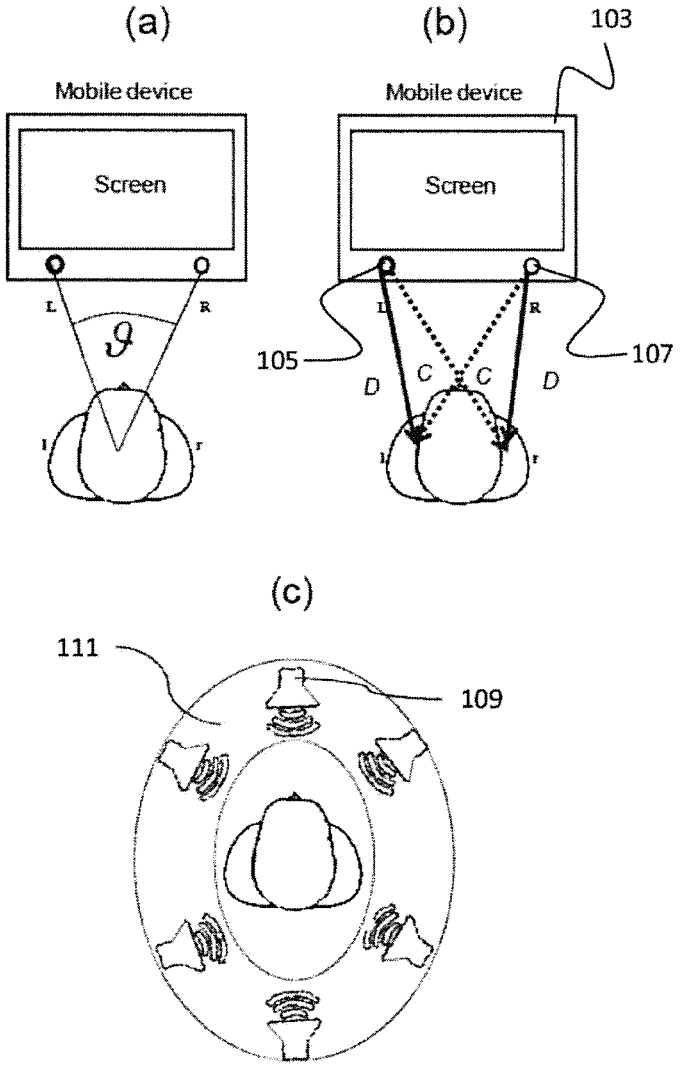
FIG. 1 shows an illustration of single-cabinet stereo sound reproduction devices.
Figure 2:
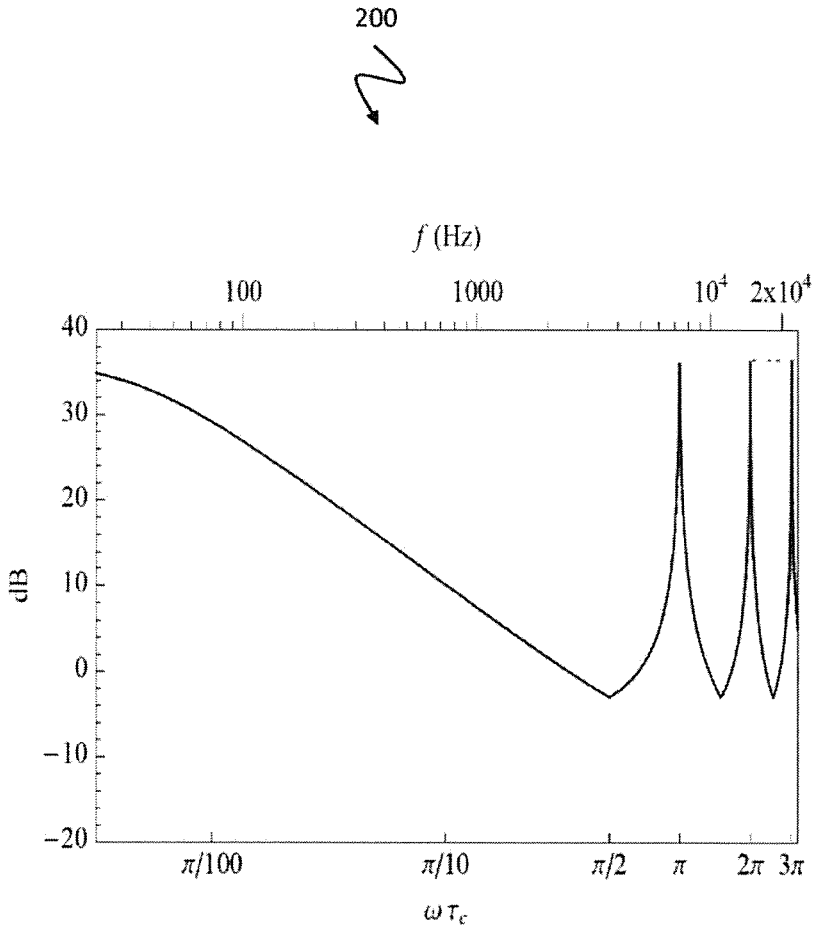
FIG. 2 shows an example frequency response of a typical crosstalk cancellation filter.
Figure 3:
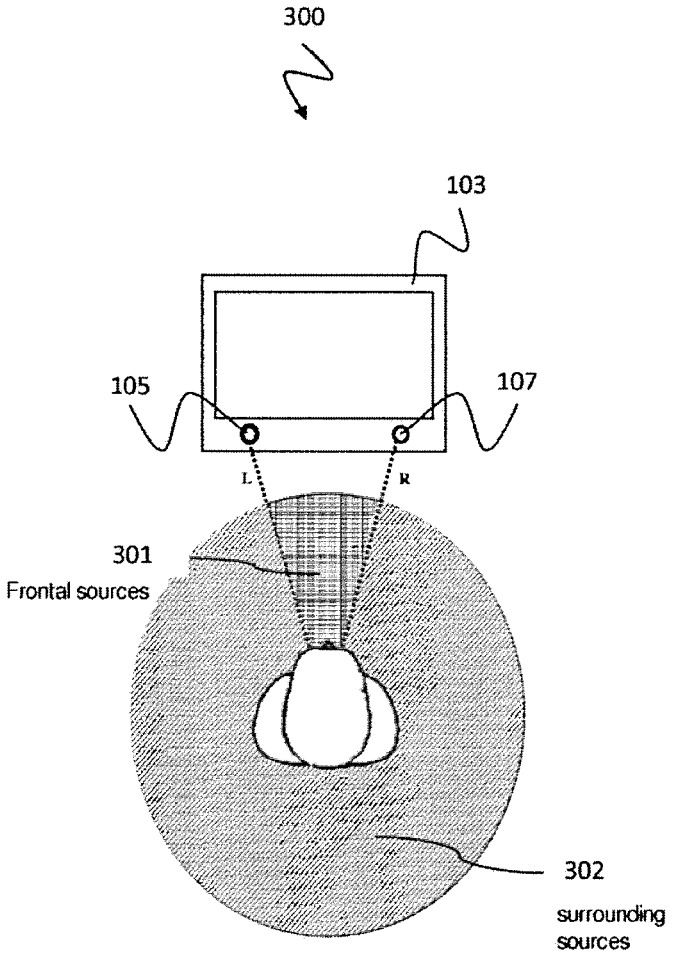
FIG. 3 shows an illustration of the discrimination of frontal sources and surrounding sources in the 2D horizontal plane.
Figure 4:
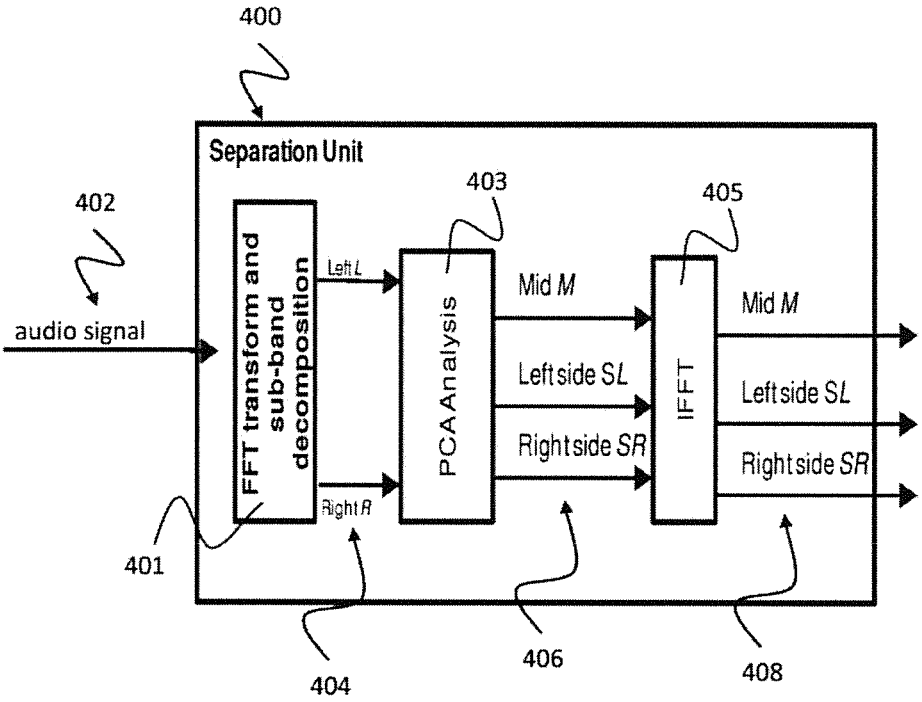
FIG. 4 shows an illustration of a converter used to separate a conventional stereo signal into frontal sources and surrounding sources.
Figure 5:
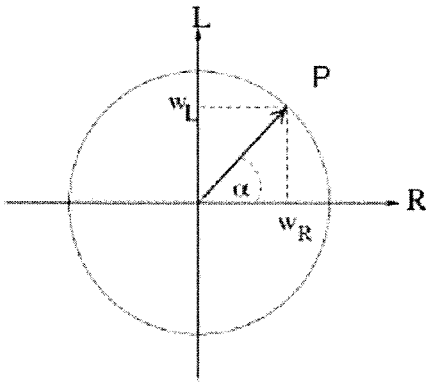
FIG. 5 shows an illustration of the separation of a stereo signal in frontal and left/right surrounding sources.
Figure 5:
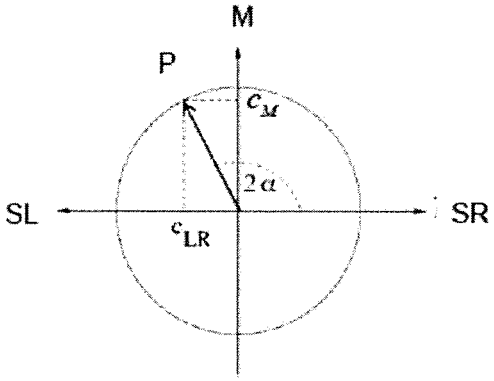

In the following detailed description, reference is made to the accompanying drawings, which form a part thereof, and in which is shown by way of illustration specific aspects in which the disclosure may be practiced. It is understood that other aspects may be utilized and structural or logical changes may be made without departing from the scope of the present disclosure. The following detailed description, therefore, is not to be taken in a limiting sense, and the scope of the present disclosure is defined by the appended claims.

The devices and methods described herein may be based on audio signals, in particular stereo signals and multichannel signals. It is understood that comments made in connection with a described method may also hold true for a corresponding device configured to perform the method and vice versa. For example, if a specific method step is described, a corresponding device may include a unit to perform the described method step, even if such unit is not explicitly described or illustrated in the figures. Further, it is understood that the features of the various exemplary aspects described herein may be combined with each other, unless specifically noted otherwise.

The methods and devices described herein may be implemented in wireless communication devices, in particular mobile devices (or mobile stations or User Equipments (UE)) that may communicate according to 3G, 4G and CDMA standards, for example. The described devices may include integrated circuits and/or passives and may be manufactured according to various technologies. For example, the circuits may be designed as logic integrated circuits, analog integrated circuits, mixed signal integrated circuits, optical circuits, memory circuits and/or integrated passives.

The methods and devices described herein may receive audio signals. An audio signal is a representation of sound, typically as an electrical voltage. Audio signals may have frequencies in the audio frequency range of roughly 20 to 20,000 Hz (the limits of human hearing). Loudspeakers or headphones may convert an electrical audio signal into sound. Digital representations of audio signals exist in a variety of formats, e.g. such as stereo audio signals or multichannel audio signals.

The devices and methods described herein may be based on stereo signals and multichannel audio signals. Stereophonic sound or stereo is a method of sound reproduction that creates an illusion of directionality and audible perspective. This may be achieved by using two or more independent audio channels forming a stereo signal through a configuration of two or more loudspeakers in such a way as to create the impression of sound heard from various directions, as in natural hearing. The term "multichannel audio" refers to the use of multiple audio tracks to reconstruct sound on a multi-speaker sound system. Two digits separated by a decimal point (2.1, 5.1, 6.1, 7.1, etc.) may be used to classify the various kinds of speaker set-ups, depending on how many audio tracks are used. The first digit may show the number of primary channels, each of which may be reproduced on a single speaker, while the second may refer to the presence of a Low Frequency Effect (LFE), which may be reproduced on a subwoofer. Thus, 1.0 may correspond to mono sound (meaning one-channel) and 2.0 may correspond to stereo sound. Multichannel sound systems may rely on the mapping of each source channel to its own loudspeaker. Matrix systems may recover the number and content of the source channels and may apply them to their respective loudspeakers. The transmitted signal may encode the information (defining the original sound field) to a greater or lesser extent; the surround sound information is rendered for replay by a decoder generating the number and configuration of loudspeaker feeds for the number of speakers available for replay.

The devices and methods described herein may be based on head-related transfer functions. A head-related transfer function (HRTF) is a response that characterizes how an ear receives a sound from a point in space; a pair of HRTFs for two ears can be used to synthesize a binaural sound that seems to come from a particular point in space. It is a transfer function, describing how a sound from a specific point will arrive at the ear (generally at the outer end of the auditory canal).

Audio signals as used in the devices and methods described herein may include binaural signals and binaural cue coded (BCC) signals. Binaural means relating to two ears. Binaural hearing, along with frequency cues, lets humans determine direction of origin of sounds. A binaural signal is a signal transmitting an auditory stimulus presented to both ears. Binaural Cue Coding is a technique for low-bitrate coding of a multitude of audio signals or audio channels. Specifically, it addresses the two scenarios of transmission of a number of separate source signals for the purpose of rendering at the receiver and of transmission of a number of audio channels of a stereo or multichannel signal. BCC schemes jointly transmit a number of audio signals as one single channel, denoted sum signal, plus low-bit-rate side information, enabling low-bit-rate transmission of such signals. BCC is a lossy technique and cannot recover the original signals. It aims at recovering the signals perceptually. BCC may operate in subbands and is able to spatialize a number of source signals given only the respective sum signal (with the aid of side information). Coding and decoding of BCC signals is described in Faller, C., Baumgarte, F.; "Binaural Cue Coding—Part II: Schemes and Applications," Transactions on Speech and Audio Processing, VOL. 11, NO. 6, 2003.

The following figures illustrate different aspects of the invention processing frontal and surrounding sources differently which allows removing large portions of the signal energy from the crosstalk cancellation system thereby reducing the crosstalk cancellation effort and the emitted output power without reducing the spatial effect.

Figure 6:
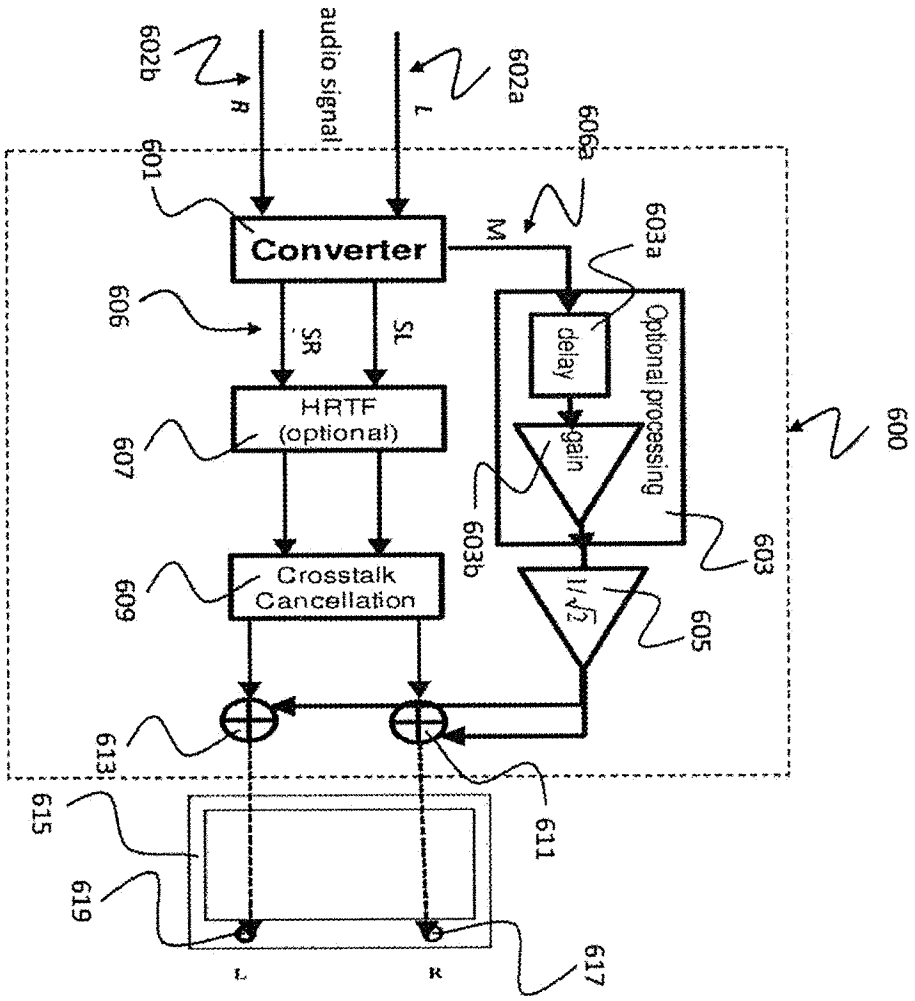
FIG. 6 shows a block diagram illustrating a stereo widening device 600 according to an implementation form.

FIG. 6 shows a block diagram illustrating a stereo widening device 600 according to an implementation form. The stereo widening device 600 may include a converter 601, an optional processing block 603, an attenuator 605, a HRTF processing block 607, a cross talk cancellation block 609 and two adders 611, 613.

The stereo widening device 600 may receive an audio signal including a left channel component 602*a* and a right channel component 602*b*. In one example, the audio signal includes a stereo audio signal. In one example, the audio signal includes the front channels of a multichannel signal. The converter 601 may convert the audio signal into a mid signal 606*a* and two side signals 606, i.e. a left side signal SL and a right side signal SR. The mid signal 606*a* may be processed by the optional processing block 603 including a delay 603*a* and a gain 603*b* and by the attenuator 605. The delayed, amplified and attenuated mid signal 606*a* may be provided to both adders 611, 613. The two side signals 606 may be processed by the HRTF processing block 607 and the crosstalk cancellation block 609. The HRTF transformed and crosstalk cancelled side signals 606 may each be provided to a respective adder, e.g. the left side signal SL to the first adder 613 and the right side signal SR to the second adder, 611. The output signal of the first adder 613 may be provided to a left loudspeaker 619 and the output signal of the second adder 611 may be provided to a right loudspeaker 617, or vice versa, of a mobile device 615.

The stereo widening device 600 can be applied to obtain a stereo widening effect for playback of stereo audio signals on loudspeakers with a small span angle. To this end, the input audio signal (L,R) may be separated into a signal containing frontal sources (Mid Signal M) and two side signals (Left side SL and Right side SR) using the converter 601:

$$\begin{bmatrix} L \\ R \end{bmatrix} = M + \begin{bmatrix} SL \\ SR \end{bmatrix}$$

The Mid signal M may contain all sources which are contained in both channels. The Side signals SL and SR may contain information which is only contained in one of the input channels. M may be removed from L,R to obtain SL,SR.

SL and SR (comprising lower signal energy than L and R) may be played with a high spatial effect using crosstalk cancellation and optionally processed using HRTFs.

M may be played directly over the two loudspeakers 617, 619. To obtain a centered location, amplitude panning may be used which results in a phantom center source. A gain reduction 603*b* may be needed in order to ensure that the original stereo perception is not changed. Playing the Mid signal M over both speakers 617, 619 may result in a 6 dB increase in sound pressure level (under ideal conditions). Therefore, a reduction 605 of M by 3 dB (or a multiplication with a gain $1/\sqrt{2}$) may be required. This is just a rough value, variations of the gain allow for adjusting to real-world conditions and listener preferences.

The optional processing block 603 comprising delay 603*a* and gain 603*b* compensation can be applied in order to compensate for additional delays and gains introduced in the crosstalk cancellation system.

The delay 603*a* may compensate for algorithmic delay in the HRTF and crosstalk cancellation. The gain 603*b* may allow for adapting the ratio between M and SL, SR producing the similar effect as M/S processing of stereo signals.

The stereo widening device 600 can also be used to process the front left and front right channels of a multichannel audio signal.

Figure 7:
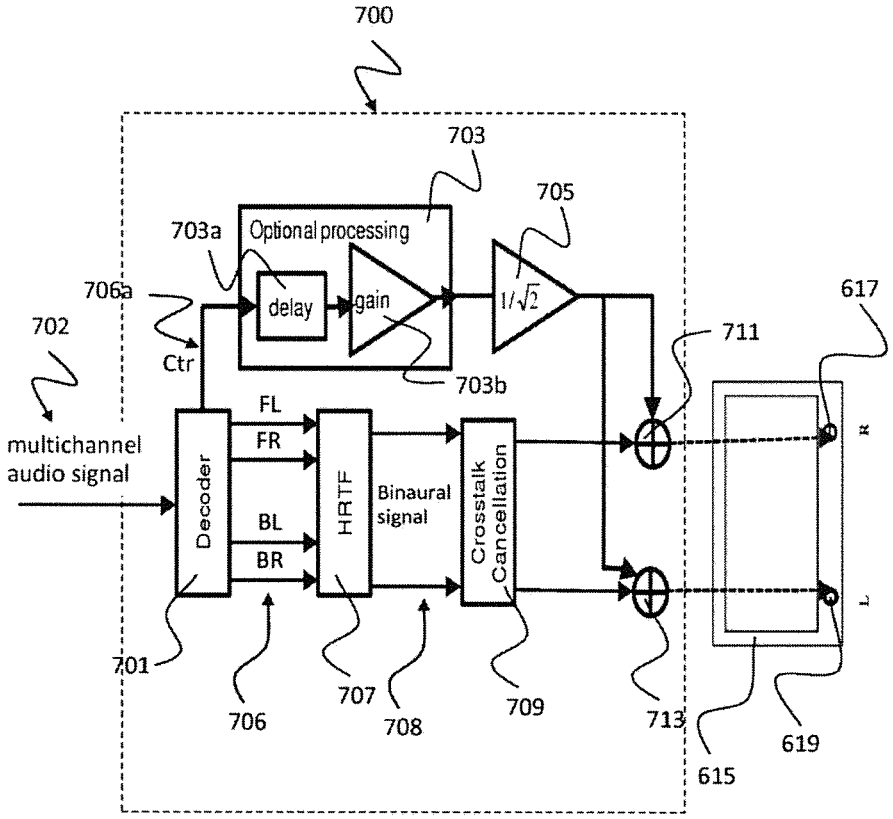
FIG. 7 shows a block diagram illustrating a multichannel processing device 700 according to an implementation form providing a high spatial effect.

FIG. 7 shows a block diagram illustrating a multichannel processing device 700 according to an implementation form providing a high spatial effect. The multichannel processing device 700 may include a decoder 701, an optional processing block 703, an attenuator 705, a HRTF processing block 707, a cross talk cancellation block 709 and two adders 711, 713.

The multichannel processing device 700 may receive a multichannel audio signal 702. The decoder 701 may decode the multichannel audio signal 702 into a center signal Ctr 706*a* and four side signals FL (Front Left), FR (Front Right), BL (Back Left), BR (Back right) 706. The center signal 706*a* may be processed by the optional processing block 703 including a delay 703*a* and a gain 703*b* and by the attenuator 705. The delayed, amplified and attenuated center signal 706*a* may be provided to both adders 711, 713. The four side signals 706 may be processed by the HRTF processing block 707 transforming the four side signals in two binaural signals 708 and further processed by the crosstalk cancellation block 709. The crosstalk cancelled binaural signals may each be provided to a respective adder, e.g. the right one to the first adder 711 and the left one to the second adder 713. The output signal of the first adder 711 may be provided to a right loudspeaker 617 and the output signal of the second adder 713 may be provided to a left loudspeaker 619, or vice versa, of a mobile device 615.

In the case of playing multichannel audio signals which may exhibit a discrete center channel Ctr 706*a* containing the frontal sources, no converter may be required. Instead, the multichannel audio signal may be decoded to obtain the individual audio channels. The center channel Ctr 706*a* containing frontal centered sources may be separated, delayed 703*a* and gain corrected 703*b* (optional), and played directly over the two speakers 617, 619. Amplitude panning may be used to create a phantom source in the center between the two speakers L and R. A gain reduction may be needed in order to ensure that the original stereo perception is not changed. In [ITU-R BS.775-3], a gain reduction 705 by 3 dB is recommended for playback of the center channel Ctr 706*a* over two front speakers 617, 618. This is just a rough value, variations of the gain allow for adjusting to real-world conditions and listener preferences.

Front Left, Front Right, and the surround channels Back Left and Back Right may be played with a high spatial effect using HRTFs to obtain a binaural signal and crosstalk cancellation. The frontal sources containing a large amount of signal energy may be played without crosstalk cancellation which reduces the crosstalk cancellation effort.

The multichannel processing device 700 may provide an optimal spatial effect because all surrounding sources may be played with high spatial effect.

Figure 8:
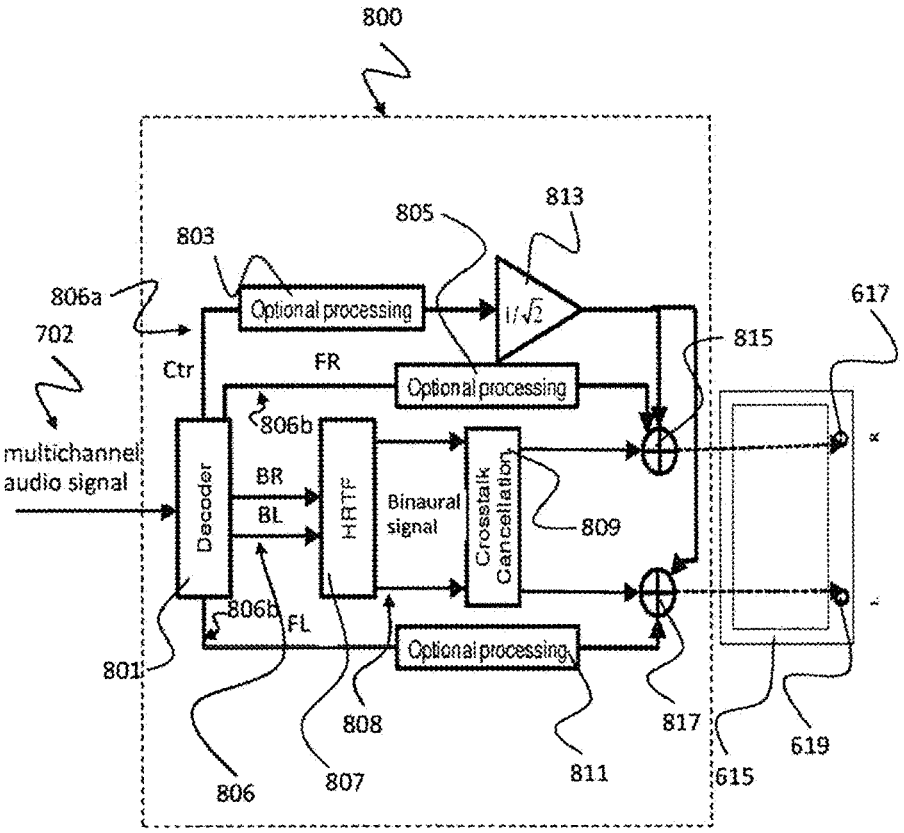
FIG. 8 shows a block diagram illustrating a multichannel processing device 800 according to an implementation form providing low energy processing.

FIG. 8 shows a block diagram illustrating a multichannel processing device 800 according to an implementation form providing low energy processing. The multichannel processing device 800 may include a decoder 801, a first optional processing block 803, a second optional processing block 805, a HRTF processing block 807, a cross talk cancellation block 809, a third optional processing block 811, an attenuator 813 and two adders 815, 817.

The multichannel processing device 800 may receive a multichannel audio signal 702. The decoder 801 may decode the multichannel audio signal 702 into a center signal Ctr 806*a* and four side signals FL (Front Left), FR (Front Right) given the reference sign 806*b*, BL (Back Left), BR (Back right) given the reference sign 806. The center signal 806*a* may be processed by the first optional processing block 803, that may correspond to the optional processing block 703 described above with respect to FIG. 7, and by the attenuator 813. The optionally processed and attenuated center signal 806*a* may be provided to both adders 815 and 817. The two front side signals FR and FL 806*b* may be each processed by the second optional processing block 805 and the third optional processing block 811, respectively. The so processed front right side signal FR may be provided to the first adder 815 and the so processed front left side signal FL may be provided to the second adder 817. The two back side signals BR and BL 806 may be processed by the HRTF processing block 807 transforming these two side signals in two binaural signals 808 and further processed by the crosstalk cancellation block 809. The crosstalk cancelled binaural signals may each be provided to a respective adder, e.g. the right one to the first adder 815 and the left one to the second adder 817. The output signal of the first adder 815 may be provided to a right loudspeaker 617 and the output signal of the second adder 817 may be provided to a left loudspeaker 619, or vice versa, of a mobile device 615.

In case that the span angle between the speakers L 619 and R 617 is large (e.g. 60 degrees), also the front left FL and front right FR channels may be played without crosstalk cancellation 809 as it is shown FIG. 8. As an example, the two front side signals FR and FL 806*b* may be treated as the center signal Ctr 806*a* (e.g. delayed and/or amplified or damped) or processed using the same first processing scheme (which is free of crosstalk cancellation). Then, only the surround channels (back left BL and back right BR) may be processed using HRTFs 807 to obtain a binaural signal 808 and reproduced using crosstalk cancellation 809. Hence, no crosstalk cancellation is applied to the two front side signals FR and FL 806*b*.

The multichannel processing device 800 may minimize the required amount of crosstalk cancellation; it may only be used for the spatial effects in the two surround channels which may reflect only a small portion of the entire signal energy. As a result, the required crosstalk cancellation effort may be minimized.

In one implementation, a combination of the multichannel processing device 800 with the stereo widening device 600 as described above with respect to FIG. 6 is used resulting in a device separating front left and front right input channels into mid M and side components of SL and SR using a converter 601 as shown above with respect to FIG. 6. Then, only the side components SL and SR but not the mid signal M may be played with crosstalk cancellation. Compared to the multichannel processing device 800 illustrated in FIG. 8, the spatial effect may be increased for the front channels without requiring the high crosstalk cancellation load of the multichannel processing device 700 described with respect to FIG. 7. The combined implementation of the multichannel processing device 800 with the stereo widening device 600 may be used as a preferred embodiment for multichannel signals.

Figure 9:
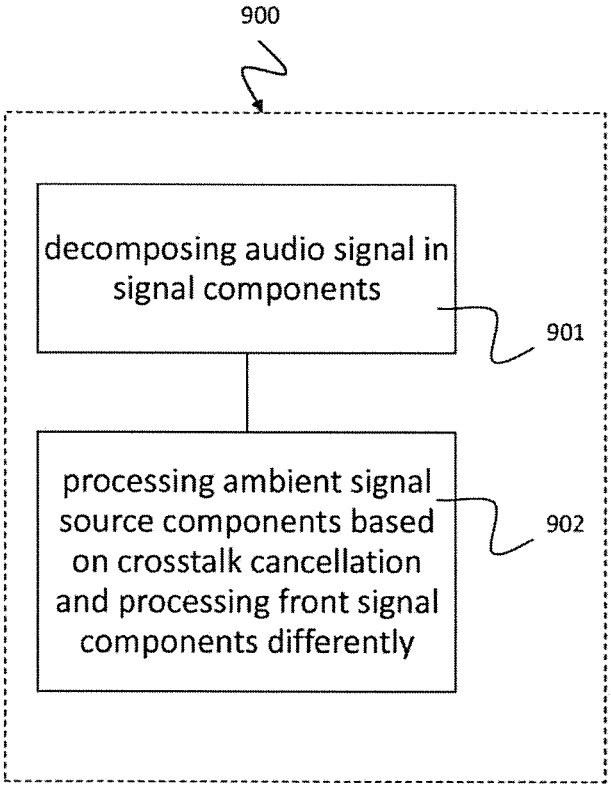
FIG. 9 shows a block diagram illustrating a method 900 for processing an audio signal according to an implementation form.

FIG. 9 shows a block diagram illustrating a method 900 for processing an audio signal according to an implementation form. The method 900 may include decomposing 901 an audio signal comprising spatial information into a set of audio signal components. The method 900 may include processing 902 a first subset of the set of audio signal components according to a first processing scheme and processing a second subset of the set of audio signal components according to a second processing scheme different from the first processing scheme. The first subset may include audio signal components corresponding to at least one frontal signal source and the second subset may include audio signal components corresponding to at least one ambient signal source. The second processing scheme may be based on crosstalk cancellation.

In an implementation form, the decomposing the audio signal may be based on Principal Component Analysis. In an implementation form, the second processing scheme may be further based on Head-Related Transfer Function processing. In an implementation form, the first processing scheme may include amplitude panning. In an implementation form, the first processing scheme may include delay and gain compensation. In an implementation form, the first and second subsets of the set of audio signal components may each include a first part associated with a left direction and a second part associated with a right direction. In an implementation form, the method 900 may include combining the first part of the first subset of the set of audio signal components after being processed according to the first processing scheme and the first part of the second subset of the set of audio signal components after being processed according to the second processing scheme to a left channel signal. In an implementation form, the method 900 may include combining the second part of the first subset of the set of audio signal components after being processed according to the first processing scheme and the second part of the second subset of the set of audio signal components after being processed according to the second processing scheme to a right channel signal. In an implementation form, the audio signal may include a stereo audio signal. In an implementation form, the decomposing may be based on converting the stereo audio signal into a mid signal component associated to the first subset of the set of audio signal components and both a left side and right side signal component associated to the second subset of the set of audio signal components.

In an implementation form, the audio signal may include a multichannel audio signal. In an implementation form, the decomposing may be based on decoding the multichannel audio signal into the following signal components: a center signal component, a front right signal component, a front left signal component, a back right signal component, a back left signal component. In an implementation form, the center signal component may be associated to the first subset of the set of audio signal components. In an implementation form, the front right, the front left, the back right and the back left signal components may be associated to the second subset of the set of audio signal components.

In an implementation form, the center signal component and both the front right and front left signal components may be associated to the first subset of the set of audio signal components. In an implementation form, both the back right and back left signal components may be associated to the second subset of the set of audio signal components. In an implementation form, the method 900 may include converting the front right and front left signal components into a mid signal component associated to the first subset of the set of audio signal components and both a left side and right side signal component associated to the second subset of the set of audio signal components.

Figure 10:
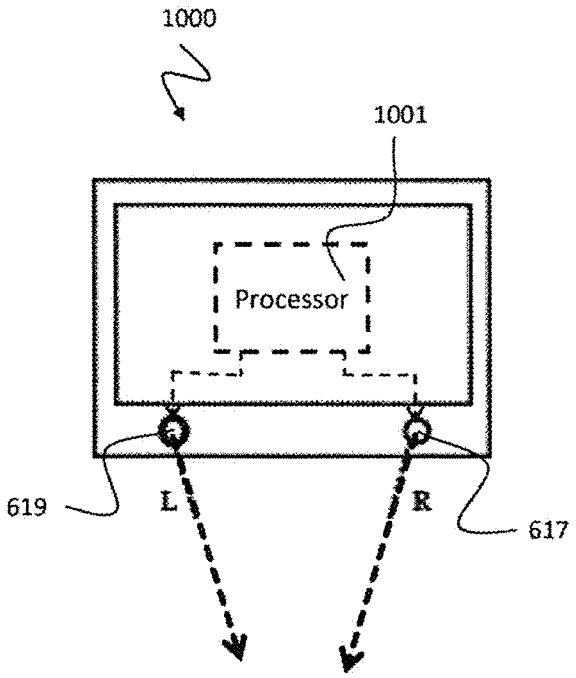
FIG. 10 shows a block diagram illustrating a mobile device 1000 including a processor 1001 for processing an audio signal according to an implementation form.

The method 900 may be implemented on a processor, e.g. a processor 1001 of a mobile device as described with respect to FIG. 10.

FIG. 10 shows a block diagram illustrating a mobile device 1000 including a processor 1001 for processing an audio signal according to an implementation form. The mobile device 1000 includes the processor 1001 that is configured to execute the method 900 as described above with respect to FIG. 9. The processor 1001 may implement one or a combination of the devices 600, 700, 800 as described above with respect to FIGS. 6, 7 and 8. The mobile device 1000 may include at least one left channel loudspeaker configured to play a left channel signal as described above with respect to FIGS. 6 to 9 and at least one right channel loudspeaker configured to play a right channel signal as described above with respect to FIGS. 6 to 9.

The methods, systems and devices described herein may be implemented as software in a Digital Signal Processor (DSP), in a micro-controller or in any other side-processor or as hardware circuit within an application specific integrated circuit (ASIC).

The invention can be implemented in digital electronic circuitry, or in computer hardware, firmware, software, or in combinations thereof, e.g. in available hardware of conventional mobile devices or in new hardware dedicated for processing the methods described herein.

The present disclosure also supports a computer program product including computer executable code or computer executable instructions that, when executed, causes at least one computer to execute the performing and computing steps described herein, in particular the method 900 as described above with respect to FIG. 9 and the techniques described above with respect to FIGS. 6 to 8. Such a computer program product may include a readable storage medium storing program code thereon for use by a computer, the program code may include instructions for decomposing an audio signal comprising spatial information into a set of audio signal components; and instructions for processing a first subset of the set of audio signal components according to a first processing scheme and processing a second subset of the set of audio signal components according to a second processing scheme different from the first processing scheme, wherein the first subset comprises audio signal components corresponding to at least one frontal signal source and the second subset comprises audio signal components corresponding to at least one ambient signal source; and wherein the second processing scheme is based on crosstalk cancellation.

While a particular feature or aspect of the disclosure may have been disclosed with respect to only one of several implementations, such feature or aspect may be combined with one or more other features or aspects of the other implementations as may be desired and advantageous for any given or particular application. Furthermore, to the extent that the terms "include", "have", "with", or other variants thereof are used in either the detailed description or the claims, such terms are intended to be inclusive in a manner similar to the term "comprise". Also, the terms "exemplary", "for example" and "e.g." are merely meant as an example, rather than the best or optimal.

Although specific aspects have been illustrated and described herein, it will be appreciated by those of ordinary skill in the art that a variety of alternate and/or equivalent implementations may be substituted for the specific aspects shown and described without departing from the scope of the present disclosure. This application is intended to cover any adaptations or variations of the specific aspects discussed herein.

Although the elements in the following claims are recited in a particular sequence with corresponding labeling, unless the claim recitations otherwise imply a particular sequence for implementing some or all of those elements, those elements are not necessarily intended to be limited to being implemented in that particular sequence.

Many alternatives, modifications, and variations will be apparent to those skilled in the art in light of the above teachings. Of course, those skilled in the art readily recognize that there are numerous applications of the invention beyond those described herein. While the present inventions has been described with reference to one or more particular embodiments, those skilled in the art recognize that many changes may be made thereto without departing from the scope of the present invention. It is therefore to be understood that within the scope of the appended claims and their equivalents, the invention may be practiced otherwise than as specifically described herein.

What is claimed is:

1. A method for processing an audio signal, the method comprising:

converting a stereo audio signal into a mid signal component, a left side signal component, and a right side signal component based on a Principal Component Analysis;

processing the mid signal component according to a first processing scheme to generate a processed mid signal component;

processing the left side signal component and the right side signal component according to a second processing scheme to generate a processed left side signal component and a processed right side signal component, with the second processing scheme being different from the first processing scheme and wherein the second processing scheme performs crosstalk cancellation; and combining the processed left side signal component and the processed mid signal component to form a processed left channel signal and combining the processed right side signal component and the processed mid signal component to form a processed right channel signal.

2. The method of claim 1, wherein the second processing scheme is based on Head-Related Transfer Function processing.

3. The method of claim 1, wherein the first processing scheme comprises amplitude panning.

4. The method of claim 1, wherein the first processing scheme comprises delay and gain compensation.

5. A method for processing an audio signal, the method comprising:

decomposing an audio signal comprising spatial information into a set of audio signal components;

processing a first subset of the set of audio signal components according to a first processing scheme and processing a second subset of the set of audio signal components according to a second processing scheme different from the first processing scheme;

wherein the first subset comprises audio signal components corresponding to at least one frontal signal source and the second subset comprises audio signal components corresponding to at least one ambient signal source;

wherein the second processing scheme is based on crosstalk cancellation;

wherein the first processing scheme is free of crosstalk cancellation;

wherein the audio signal comprises a multichannel audio signal; and decomposing is based on decoding the multichannel audio signal into the following signal components:

a center signal component, a front right signal component, a front left signal component, a back right signal component, and a back left signal component;

wherein:

the center signal component and both the front right and front left signal components are associated to the first subset of the set of audio signal components; and both the back right and back left signal components are associated to the second subset of the set of audio signal components;

wherein the first subset and the second subset of the set of audio signal components each comprise a first part associated with a left direction and a second part associated with a right direction;

wherein the method further comprises:

combining the first part of the first subset of the set of audio signal components after being processed according to the first processing scheme and the first part of the second subset of the set of audio signal components after being processed according to the second processing scheme to a left channel signal; and combining the second part of the first subset of the set of audio signal components after being processed according to the first processing scheme and the second part of the second subset of the set of audio signal components after being processed according to the second processing scheme to a right channel signal.

6. A method for processing an audio signal, the method comprising:

decomposing an audio signal comprising spatial information into a set of audio signal components;

processing a first subset of the set of audio signal components according to a first processing scheme and processing a second subset of the set of audio signal components according to a second processing scheme different from the first processing scheme;

wherein the first subset comprises audio signal components corresponding to at least one frontal signal source and the second subset comprises audio signal components corresponding to at least one ambient signal source;

wherein the second processing scheme is based on crosstalk cancellation;

wherein:

the audio signal comprises a multichannel audio signal; and decomposing is based on decoding the multichannel audio signal into the following signal components:

a center signal component, a front right signal component, a front left signal component, a back right signal component, and a back left signal component;

wherein decomposing further comprises:

converting the front right and front left signal components into a mid signal component associated to the first subset of the set of audio signal components and into a left side and a right side signal component both associated to the second subset of the set of audio signal components;

the center signal component is associated to the first subset of the set of audio signal components; and both the back right and back left signal components are associated to the second subset of the set of audio signal components.

7. The method of claim 6, wherein the first processing scheme is free of crosstalk cancellation.

8. A mobile device, comprising:

a processor; and memory coupled to the processor, the memory comprising instructions that, when executed by the processor, cause the mobile device to:

convert a stereo audio signal into a mid signal component, a left side signal component, and a right side signal component based on a Principal Component Analysis, process the mid signal component according to a first processing scheme to generate a processed mid signal component, and process the left side signal component and the right side signal component according to a second processing scheme to generate a processed left side signal component and a processed right side signal component, with the second processing scheme being different from the first processing scheme and wherein the second processing scheme performs crosstalk cancellation, and combine the processed left side signal component and the processed mid signal component to form a processed left channel signal and combine the processed right side signal component and the processed mid signal component to form a processed right channel signal.

9. A mobile device, comprising:

a processor; and memory coupled to the processor, the memory comprising instructions that, when executed by the processor, cause the mobile device to:

decompose an audio signal comprising spatial information into a set of audio signal components, process a first subset of the set of audio signal components according to a first processing scheme, and process a second subset of the set of audio signal components according to a second processing scheme different from the first processing scheme;

wherein the first subset comprises audio signal components corresponding to at least one frontal signal source and the second subset comprises audio signal components corresponding to at least one ambient signal source;

wherein the second processing scheme is based on crosstalk cancellation;

wherein the first processing scheme is free of crosstalk cancellation;

wherein the audio signal comprises a multichannel audio signal;

the instructions, when executed by the processor, cause the mobile device to:

decode the multichannel audio signal into the following signal components:

a center signal component, a front right signal component, a front left signal component, a back right signal component, and a back left signal component;

the center signal component and both the front right and front left signal components are associated to the first subset of the set of audio signal components; both the back right and back left signal components are associated to the second subset of the set of audio signal components; wherein the first subset and the second subset of the set of audio signal components each comprise a first part associated with a left direction and a second part associated with a right direction; and wherein the instructions, when executed by the processor, cause the mobile device to:

combine the first part of the first subset of the set of audio signal components after being processed according to the first processing scheme and the first part of the second subset of the set of audio signal components after being processed according to the second processing scheme to a left channel signal, and combine the second part of the first subset of the set of audio signal components after being processed according to the first processing scheme and the second part of the second subset of the set of audio signal components after being processed according to the second processing scheme to a right channel signal.

10. A mobile device, comprising:

a processor; and memory coupled to the processor, the memory comprising instructions that, when executed by the processor, cause the mobile device to:

decompose an audio signal comprising spatial information into a set of audio signal components, process a first subset of the set of audio signal components according to a first processing scheme, and process a second subset of the set of audio signal components according to a second processing scheme different from the first processing scheme;

wherein the first subset comprises audio signal components corresponding to at least one frontal signal source and the second subset comprises audio signal components corresponding to at least one ambient signal source;

wherein the second processing scheme is based on crosstalk cancellation;

wherein the audio signal comprises a multichannel audio signal; the instructions, when executed by the processor, cause the mobile device to:

decode the multichannel audio signal into the following signal components:

a center signal component, a front right signal component, a front left signal component, a back right signal component, and a back left signal component; and convert the front right and front left signal components into a mid signal component associated to the first subset of the set of audio signal components and into a left side and a right side signal component both associated to the second subset of the set of audio signal components;

wherein the center signal component is associated to the first subset of the set of audio signal components; and both the back right and back left signal components are associated to the second subset of the set of audio signal components.

* * * * *